US005305990A

United States Patent [19]

Sherwood

[11] Patent Number: 5,305,990

[45] Date of Patent: Apr. 26, 1994

[54] METALLURGICAL FURNACE VACUUM SLAG REMOVAL

[76] Inventor: William L. Sherwood, 7249 Cypress Street, Vancouver, B.C., Canada, V6P 5M2

[21] Appl. No.: 15,580

[22] Filed: Feb. 10, 1993

[51] Int. Cl.[5] ..... C22B 7/04

[52] U.S. Cl. ..... 266/45; 266/205; 75/582; 75/584

[58] Field of Search ..... 266/45, 227, 205; 75/582, 584

[56] References Cited

U.S. PATENT DOCUMENTS

| | | | |
|---|---|---|---|
| 3,867,132 | 2/1975 | Perry | 266/227 |
| 3,979,108 | 9/1976 | Nagasaki et al. | 266/227 |
| 4,077,615 | 3/1978 | Nagasaki et al. | 266/227 |

FOREIGN PATENT DOCUMENTS

| | | | |
|---|---|---|---|
| 0025957 | 6/1987 | Japan | 75/582 |
| 0027348 | 6/1987 | Japan | 75/582 |
| 0802224 | 2/1981 | U.S.S.R. | 75/582 |

*Primary Examiner*—Scott Kastler

[57] ABSTRACT

A process and apparatus carries out the direct removal of slag floating on the molten metal within a metallurgical furnace via vacuum suction-tube which is inserted from above through a furnace discharge opening. The tube discharge is connected into an evacuated external slag-cooling chamber, within which the slag stream exiting the suction-tube is granulated by impinging water jets. The water and entrained slag granules descend by gravity through a communicating water-column vacuum-leg, terminating in an atmosphere-exposed pool, within which the granules are collected on a conveyor which dewaters the granules while carrying the slag out of the pool to an external pile or bin. The invention is capable of realizing slow slag discharge at controlled rates over long time periods, as well as in conjunction with the simultaneous and continuous metal withdrawal by a somewhat analagous metal siphon tube into an evacuated metal withdrawal chamber for casting. It is particularly suited to discharge via the annular discharge opening from oxy-fuel fired rotary furnaces and the preferred embodiment includes effective means for closure and sealing of the discharge opening, concurrently with furnace heating and withdrawal of metal and slag. Appropriate means are also provided for positioning and supporting the vacuum chamber assemblies, also inserting and removing the slag and metal tubes, in a coordinated non-interfering manner.

15 Claims, 2 Drawing Sheets

METALLURGICAL FURNACE VACUUM SLAG REMOVAL

The invention relates to metal melting and refining and, more particularly, to a process and apparatus for removal of slag separately from the molten metal out of metallurgical furnaces during operation.

Metallurgical furnace operations, including rotary furnaces as described in my U.S. Pat. Nos. 4,105,438; 4,456,476; 4,541,865; 4,615,511; and 5,163,947; generally provide for discharging of slag by means of gravity flow through a discharge opening or by overflowing a sill, often including skimming devices and/or tilting of the furnace during discharge. Continuous discharge or slow discharge during prolonged periods are usually not attempted, one reason being difficulty with preventing the accretion and buildup of solidified slag on discharge openings at low rates of discharge.

Vacuum slag skimmers are known technology, per se, but in ferrous metallurgy have generally been applied to rapid skimming of slag from ladles after tapping is completed from a blast furnace, converter or electric-arc furnace. One recent system provides for water-quenching and slag granulation by water jet immediately, at a mechanical-arm manipulated suction head, also incorporating substantial atmosphere ingestion at the nozzle inlet, connected by moving duct to a water-slag separator stationed on an adjacent platform. These known techniques, however, do not provide for discharge of slag from the process furnace itself separately and simultaneously with the discharge of metal, or lend themselves to prolonged or continual discharge coinciding with continuous processing.

Furthermore, they generally follow the well-known principles of the widely used "wet vacuum", whereby the slag, along with a variable quantity of air, are violently ingested and immediately mixed with water at or near the vacuum nozzle as it is moved across the slag surface, separate cooling of the nozzle assembly being perhaps the salient improvement over long-established wet vacuum technology. The objective is rapid and effective clean-off of slag layers on ladles and the like, rather than controlled rates of removal from the confined space of a furnace interior maintained at high temperature.

It is a principal object of the present invention to carry out a clean discharge of slag directly from a metallurgical process furnace separately from the molten metal.

Another object is to provide for prolonged periods of continuous slag discharge at a controlled rate also adapted to take place simultaneously with the discharge of molten metal.

A further object is to deliver the slag in granulated form, sufficiently cooled to facilitate subsequent handling or disposal.

Still another object is to provide for control of slag level in the furnace throughout the course of processing.

A still further object is to provide a suitable closure for the annular discharge end opening of a rotary metallurgical process furnace, which also facilitates heating and sealing of the opening at the same time as removing metal and slag from the furnace.

An additional object is to provide for convenient placement, positioning and removal of slag and metal withdrawal assemblies preceding, during and following operating campaigns.

According to one aspect of the invention, a process is provided for slag separation and removal from a metallurgical process furnace containing a liquid metal bath and a slag layer floating on the bath surface, comprising: withdrawing liquid slag from the layer by way of a slag suction-tube inserted into the furnace through the furnace discharge opening with slag entering the tube inlet immersed in the slag layer but above the metal bath surface and the outlet connected and discharging into a slag-cooling chamber positioned outside of the furnace; evacuating the cooling chamber maintaining a controlled vacuum pressure sufficient to cause a stream of slag to flow through the tube from inlet to outlet; introducing liquid coolant into the chamber to intercept and solidify the slag stream to form granulated slag; collecting and removing the granulated slag and coolant from the cooling chamber; and separating and recovering the granulated slag from the liquid coolant.

The apparatus for conducting the process comprises: a slag cooling chamber positioned outside a furnace discharge opening; a slag suction-tube with the outlet opening connected into the cooling chamber and adapted to project into the furnace through the discharge opening with the tube inlet penetrating into a layer of slag floating on the surface of the metal; a controlled-pressure-vacuum gas outlet adapted to adjust and maintain a controlled vacuum pressure within the cooling chamber and draw a stream of hot liquid slag through the suction tube into the chamber; coolant injection means adapted to introduce liquid coolant into the chamber directed to intercept the slag entering the chamber and solidify the slag into granulated form; and granulated slag collection and removal means from within the cooling chamber. A preferred embodiment incorporates a coolant column extension down from the bottom of the slag cooling chamber. The column opens at the bottom into an atmosphere-exposed coolant pool, whereby coolant rises in the column to a height above the pool surface equivalent to the vacuum pressure head within the chamber, and the granulated slag descends through the column under the influence of gravity and coolant circulation, into the pool where it is collected, removed and dewatered by means of a conveyor or the like.

Another preferred feature is mounting of the chamber integral with a carriage supported and positioned along an inclined track with travel in the direction of suction-tube insertion into the furnace, thereby being adapted for effecting tube insertion and removal, as well as regulation of the depth of suction-tube inlet penetration of the slag layer when in the operating position.

The process and apparatus is most advantageously employed together with vacuum withdrawal of liquid metal into an external withdrawal chamber by way of a separate metal siphon tube also inserted through the discharge opening into the furnace, thereby realizing discharge of metal and slag simultaneously and separately, at controlled rates maintained over long time periods.

As the preferred embodiment, the respective withdrawal chambers including tubes for metal and slag are each mounted on a carriage adapted to run on tracks inclined an a direction parallel to the direction of tube insertion into the furnace. The guide tracks of at least one said respective chambers are, in turn, supported on a second set of tracks for guided movement in a horizontal direction in perpendicular orientation to the direction of tube insertion.

BRIEF DESCRIPTION OF THE DRAWINGS

Various other objects, features and advantages of the process and apparatus of this invention will become apparent from the following detailed description and claims, and by referring to the accompanying drawings, in which:

Referring to FIG. 1, liquid metal bath 6 and floating slag layer 7, heated by burner 4, are held within rotary furnace shell 1 lined with refractory 2 as retained behind the restriction of annular discharge opening 5. Slag suction-tube 8 is attached into slag granulating cooling chamber 12 with inlet 9 immersed in slag layer 7 during slag removal. Suction effected via vacuum pressure duct 14 causes liquid slag 7 to enter inlet 9, flow up through tube 8 and spout from outlet 10 in a slag stream 11 flowing into the interior of chamber 12, which is interupted by coolant jets 16 supplied with coolant via pressurized header piping 13 and nozzle 15. The coolant jet stream 16 can also be shaped and deflected to impinge sharply on the clear slag stream 11, such as by baffle plate 36, with action inside chamber 12 being observed through access/sight port 47. The rapid cooling, together with physical coolant-slag interaction within chamber 12, freezes the slag into granulated form.

Figure 1:
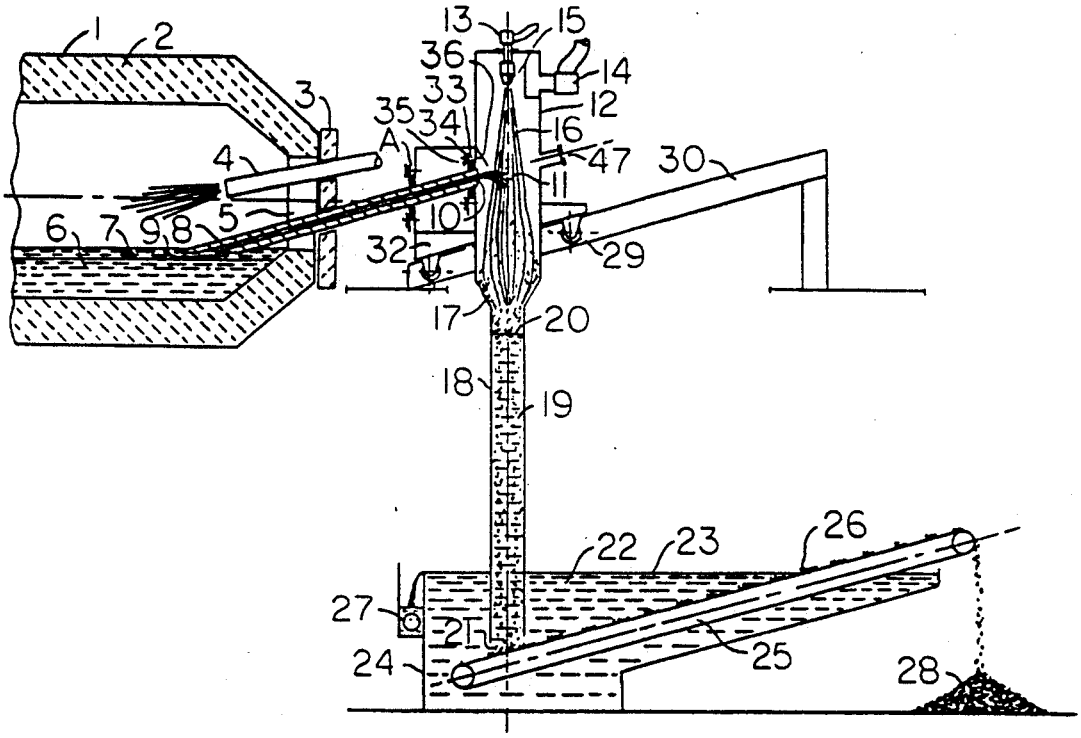
FIG. 1 is a diagrammatic side view, in section along plane 1—1 of FIG. 3, illustrating the principal features of the slag removal assembly in operation.

The bottom of slag cooling chamber 12 narrows down conically into coolant column enclosure 18 which extends further downwards with a bottom opening 21 submerged in coolant pool 22, having pool surface 23 open to atmosphere. The height of enclosure 18 exceeds the usual coolant head equivalent of the vacuum pressure applied within chamber 12. Granulated slag 17 is washed down into coolant column top surface 20, of a height above coolant pool surface 23 corresponding to the coolant pressure head equivalent of the chamber vacuum pressure. Both coolant and granulated slag descend through column 19, coolant naturally descending at the same average rate as from chamber 12. Conveyor 25 is positioned to intercept and collect the bulk of the descending granulated slag, lift it above the pool surface to dewatering area 26 for drainage of coolant, and discharge it, for example, into a pile 28, or hopper, for subsequent transfer and disposal. The spent coolant can overflow by gravity, for example, into a duct 27 leading to a sump from which it is pumped and cooled in a tower or pond, settling or filtering out fine granulated slag, and then re-pumped and recirculated to header piping 13.

The chamber 12, which appropriately comprises a fabricated steel or stainless steel cylinder, for example, about 2 feet in diameter, with a fabricated bottom conical transition into column enclosure 18, comprising a pipe, for example, 6 to 12 inches in diameter, is fastened to rigid frame carriage 32 of, for example, welded plate, angle and channel construction, incorporating cooling assembly support rollers 29 riding within rigidly supported inclined guide track 30. The carriage 32 is positioned, for example, by a hydraulic cylinder, mechanical winch or the like, effecting controlled movement and holding along guide track 30 in the parallel direction to that of inserting suction-tube 8 into the furnace. The internal jets 16 normally provide sufficient chamber cooling from inside the chamber, but supplementary cooling by externally applied coolant or water jacketing may also be included. The slag suction-tube 8 requires a rigid cantilevered attachment to the vessel, preferably sealed leak-tight against the internal vacuum, and also readily detachable. One suitable construction comprises seal ring 33 of compressible, heat-resistant gasket material, positioned and compressed around the suction-tube and against the chamber wall by compression-plate ring 35, tightened and released by dogs 34 or bolts. A second seal ring assembly 33A, 34A and 35A, integral with support frame 32, effects rigid two-point cantilevered support of tube 8.

In order to avoid slag solidification within slag suction-tube 8, the tube should be preheated prior to commencing slag removal, and the starting of flow under full operating vacuum pressure is also desirable. Preheating may be accomplished by electric resistance elements, or burners, along the tube sides, and the tube inlet end by pre-insertion into the furnace, but held above the slag. A rupture-disc may also be employed to block either inlet 9 or outlet 10, either fusible or broken mechanically by use of a rod or lance inserted via access/sight port 47, thereby preventing ingress of atmosphere or furnace gases during vacuum pumpdown.

Figure 2:
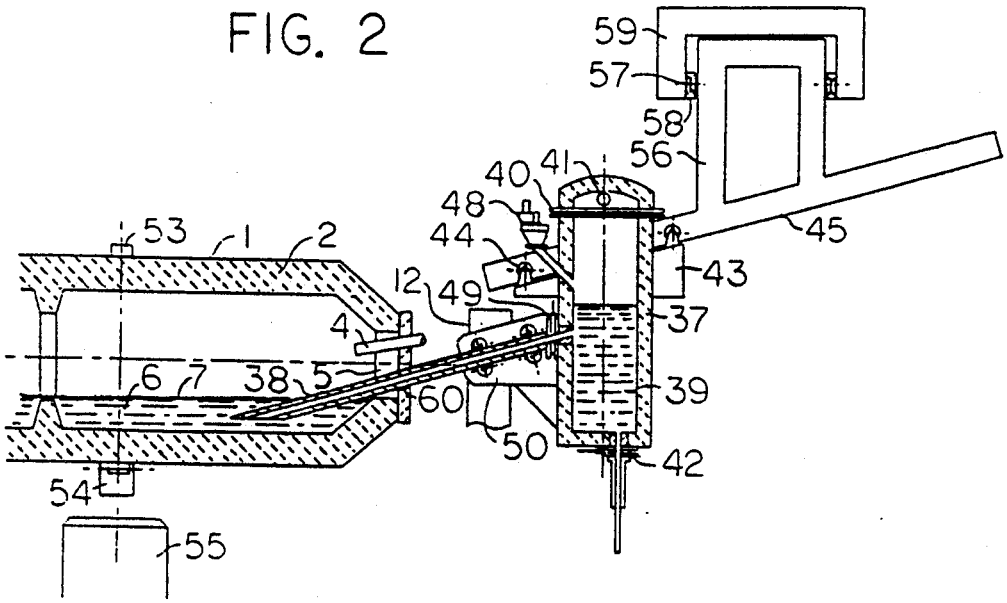
FIG. 2 is a diagrammatic side view, in section along plane 2—2 of FIG. 3, illustrating the principal features of the molten metal withdrawal assembly in operation.
Figure 3:
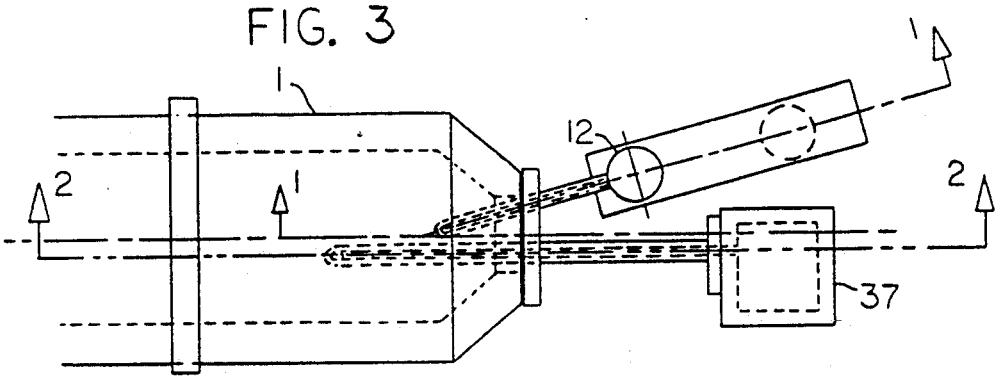
FIG. 3 is a location plan, illustrating suitable relative positions of the respective slag and metal withdrawal assemblies shown in FIGS. 1 and 2.

Referring to FIG. 2, refractory-lined metal withdrawal vessel 37 is supported within carriage 43 which incorporates rollers 44 riding upon inclined support guide tracks 45. The carriage is mechanically or hydraulically positioned (not shown), as desired along the length of track 45. Siphon-tube 38 is supported by rollers 51 mounted on cantilevered support bracket 50, actuated to maintain pressure for a sealed connection with 3-plate slide-gate valve 49. Valve details are not illustrated, numerous variations being applicable, as known in the arts of continuous casting and pressure pouring. Tracks 45, in turn, are suspended from moving support 56, incorporating a second set of perpendicular rollers 57, adapted to ride in fixed guide track 58, as incorporated within stationary bridge 59 and horizontally oriented in a direction substantially perpendicular to track 45 and thus to the direction of insertion of siphon-tube 38.

In preparation for operation, with carriage 43 in the upper withdrawn position, the support frame 56 is aligned with furnace aperture 60, then the siphon-tube inserted by assembly movement along track 45. The two-part withdrawal vessel 37, closed vacuum-tight by seal ring 40, is evacuated via vacuum duct 41, followed by opening slide gate 49 filling the vessel, subsequently opening valve 42 to allow metal pool 39 to discharge for casting operation. Alloys to adjust metal composition are introduced via vacuum-lock 48.

Figure 4:
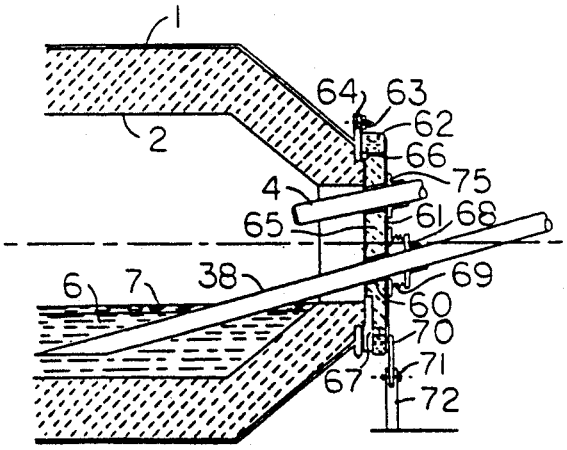
FIG. 4 is a side view, in section, of a rotary furnace end closure assembly, showing additional detail of the interface between furnace and withdrawal assemblies.
Figure 5:
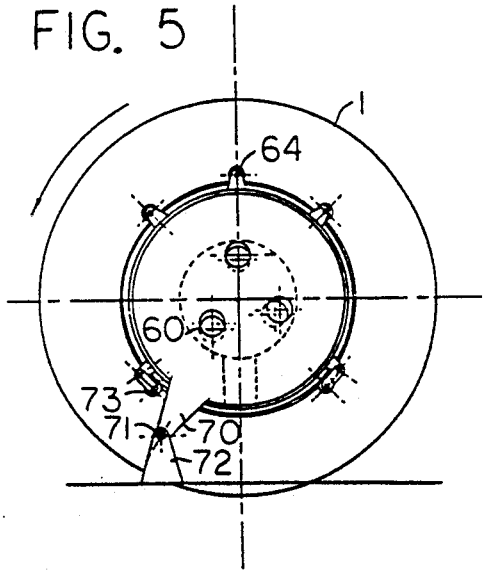
FIG. 5 is an end view of FIG. 5, included to clarify the features illustrated.

FIGS. 4 and 5 illustrate a suitable rotary furnace end closure assembly to isolate the high-temperature furnace interior from the surrounding exterior atmosphere during operation. The closure structure comprises end plate 61 bounded by circumferential water jacket 62, backed with regractory 65 acting as the principal heat barrier. In order to maintain a close and fixed relation between furnace and closure, the furnace is provided with circumferential end support guide ring 63 incorporating an outside vee guide track. The closure weight is carried by upper support-guide rollers 64 fixed to the closure and lower segment axial position is maintained by lower rollers 73, hydraulically or mechanically spring-loaded to allow convenient removal at the same time as clearance-free tracking during operation. Clockwise rotation is prevented by means of loose pin 71 acting upon closure torque arm 70 against fixed stationary member 72. Sealing between furnace and closure perimeter is effected by means of a gas curtain directed from slot or slots 67 from pressure header 66 against ring 63, blocking the escape of any furnace gases or particulates. By employing argon or other inert gas for this curtain, outside air is also completely excluded from the furnace interior. The curtain header pressure, and thereby argon consumption, can also be minimized by maintaining very close clearances between pressure header 66 and guide ring 63, for example, measuring by feeler gauges and shimming of the guide-roll stand mounting to eliminate excess clearance. The burner pipe opening can be sealed simply by a support flange 75. Slag and metal withdrawal tube openings are appropriately sealed by a flange 68 and bellows 69 combination, or may also employ a gas-curtain seal. For furnace interior access, this closure can be handled by crane after retracting the lower rollers 73 or, for example, by a floor-supported carriage on casters, with closure-matching frame incorporating hydraulic or mechanical closure lifters.

The invention may be illustrated by an example. An oxy-gas fired rotary steel melting furnace is operated to yield 40 tons per hour of metal and 3 tons per hour of slag. Slag suction-tube 8 is mullite refractory, approximately 9 feet long, 5 inches diameter with a ¾-inch diameter opening. The tube is mounted with an approximate 15 degree slope, or 2-½ feet elevation difference between inlet and outlet. The chamber 12 is a fabricated stainless steel cylinder 2 feet in diameter tapered at the bottom into a 10-inch straight pipe column 18 which is 24 feet in total length. A 3-inch header pipe 13 supplies recirculated water coolant to a 3-inch full jet nozzle delivering approximately 350 gallons per minute at 80 pounds per square inch pressure. The vacuum pressure is controlled within the range of approximately 6 to 8 pounds per square inch, effecting a slag velocity of about 3 feet per second through tube 8, to correspond with the average generation rate of 3 tons per hour. The water jet granulates and cools the slag, propelling it down into column-top surface 20, which is held approximately 14 feet above pool surface 23 by the above vacuum pressure. The granulated slag discharged from conveyor 25 is regularly weighed, and the vacuum pressure adjusted to maintain a discharge rate similar to the rate of production. The water temperature increases 20–25 degrees during each cycle, due to heat absorbed from cooling the hot slag granules.

It will be appreciated that a process and apparatus for the removal of slag from a furnace separately and simultaneously with the metal has been described and illustrated and that modifications and variations may be made by those skilled in the art, without departing from the scope of the invention defined in the appended claims.

I claim:

1. A process for slag separation and removal from a metallurgical process furnace containing a liquid metal bath and a slag layer floating on the surface of said bath, comprising the combination of the following steps: withdrawing liquid slag from said slag layer by way of a slag suction-tube inserted into the furnace through said furnace discharge opening with slag entering the inlet said tube immersed in said slag layer but above said metal bath surface and the outlet connected and discharging into a slag cooling chamber positioned outside of the furnace;

evacuating said chamber maintaining a controlled vacuum pressure sufficient to cause a stream of slag to flow from said tube inlet exiting said outlet;

introducing liquid coolant into said chamber to intercept and solidify said stream to form granulated slag;

collecting and removing said granulated slag and coolant from said chamber; and separating and recovering said granulated slag from said coolant.

2. A process for slag separation and removal from a metallurgical process furnace containing a liquid metal bath and a slag layer floating on the surface of said bath, comprising the combination of the following steps:

withdrawing liquid metal from said liquid metal bath by way of a liquid metal siphon-tube inserted through a furnace discharge opening penetrating through said slag with the siphon-tube inlet opening submerged within said metal bath and the outlet discharging into a pool of molten metal confined within an enclosed, evacuated metal withdrawal chamber outside the furnace;

withdrawing liquid slag from said slag layer by way of a slag suction-tube inserted into the furnace through said furnace discharge opening with slag-entering the inlet said tube immersed in said slag layer but above said metal bath surface and the outlet connected and discharging into a slag cooling chamber positioned outside of the furnace;

evacuating said slag cooling chamber maintaining a controlled vacuum pressure sufficient to cause a stream of slag to flow from said suction tube inlet exiting said outlet;

introducing liquid coolant into said slag cooling chamber to intercept and solidify said stream to form granulated slag;

collecting and removing said granulated slag and coolant from said chamber; and separating and recovering said granulated slag from said coolant.

3. A process for slag separation and removal from a metallurgical process furnace containing a liquid metal bath and a slag layer floating on the surface of said bath, comprising the combination of the following steps:

withdrawing liquid slag from said slag layer by way of a slag suction-tube inserted into the furnace through said furnace discharge opening with slag entering the inlet said tube immersed in said slag layer but above said metal bath surface and the outlet connected and discharging into a slag cooling chamber positioned outside of the furnace;

evacuating said chamber maintaining a controlled vacuum pressure sufficient to cause a stream of slag to flow from said tube inlet exiting said outlet;

introducing liquid coolant into said chamber to intercept and solidify said stream to form granulated slag;

allowing said granulated slag and coolant to flow by gravity into a descending laterally enclosed coolant column extension from the bottom said chamber, said granulated slag descending through and exiting said column into an atmosphere-exposed collection pool, said coolant column height substantially corresponding to said coolant height vacuum pressure equivalent; and collecting cooled and granulated slag from said pool.

4. A process according to claim 3 wherein a bottom outlet opening from said laterally enclosed column is positioned above a conveyor submerged in said collection pool, which includes the step of allowing said granulated slag to settle and collect on said conveyor, lifting and transferring said granulated slag out of said pool via said conveyor.

5. A process according to claim 1, claim 2 or claim 3 including the step of raising and lowering the slag suction-tube inlet according to changes in the levels of metal and slag surfaces, thereby maintaining said inlet submerged in the slag layer only.

6. A process according to claim 1, claim 2 or claim 3 wherein said controlled vacuum pressure within said slag cooling chamber is maintained less than the equivalent liquid metal head corresponding to the height between said suction tube inlet and outlet openings, said vacuum pressure thereby being less that that required to cause metal to traverse the entire suction tube length on any occasions when the tube inlet penetrates the metal, and including the additional step of breaking the vacuum following any such penetration of the liquid metal, to allow metal entrained in the suction tube to flow by gravity back into the bath by gravity.

7. A process according to claim 1, claim 2 or claim 3 wherein said liquid metal and said slag are discharged simultaneously and continuously.

8. An apparatus for slag separation and removal from a metallurgical process furnace containing a liquid metal bath and a slag layer floating on the surface of said bath comprising, in combination:

slag cooling chamber means positioned outside a furnace discharge opening;

slag suction-tube means with the outlet opening connected into said cooling chamber means and adapted to project into the furnace through said discharge opening with the tube inlet opening penetrating into a layer of slag floating on the surface of the metal;

a controlled-pressure-vacuum gas outlet adapted to adjust and maintain a controlled vacuum pressure within said cooling chamber and draw a stream of hot liquid slag through said suction-tube into said chamber;

coolant injection means adapted to introduce liquid coolant into said chamber directed to intercept the slag from said stream following entry into said chamber and solidify said slag into granulated form; and granulated slag collection and removal means from within said chamber.

9. An apparatus according to claim 8 wherein said granulated slag collection and removal means comprises a coolant column enclosure opening and connected at the top into said slag cooling chamber means and with bottom opening submerged in a coolant pool having surface exposed to atmosphere, said column thereby being adapted to confine and maintain a column of coolant of height corresponding to the coolant head equivalent of said controlled vacuum pressure, through which granulated slag descends by gravity into said pool and settles for collection.

10. An apparatus according to claim 9 which also includes conveyor means within said atmosphere-exposed coolant pool, said conveyor being adapted to receive and collect said granulated slag as it descends by gravity and elevate, partially dewater and transfer said granulated slag out of said pool.

11. An apparatus according to claim 8 wherein said slag cooling chamber means and said slag suction-tube means are connected together in an integral assembly supported for movement along a guided, inclined track, also including an actuator for said assembly adapted for holding in position and controlled movement of said assembly along said track, effecting insertion said suction-tube through said discharge opening and adjustment of said tube inlet height and thereby the depth of insertion of said suction-tube inlet in said slag layer inside the furnace.

12. An apparatus according to claim 8 wherein said metallurgical process furnace comprises a rotary furnace incorporating an axial annular discharge opening and wherein said slag cooling chamber means and said slag suction-tube means are connected together in an integral assembly supported for movement along a guided, inclined track, also including an actuator for said assembly adapted for holding in position and controlled movement of said assembly along said track, effecting insertion said suction-tube through said discharge opening and adjustment of said tube inlet height and thereby the depth of insertion of said suction-tube inlet in said slag layer inside the furnace; which also includes an enclosed, evacuated metal withdrawal chamber outside the furnace, incorporating a liquid metal siphon tube adapted for insertion through said furnace discharge opening penetrating through the slag with inlet submerged within said metal bath, adapted for withdrawing metal from the furnace separately from and simultaneously with, the withdrawal of slag via said slag suction-tube.

13. An apparatus according to claim 12 wherein said metal withdrawal chamber is supported for controlled position by a travelling frame incorporating an inclined track providing for chamber movement substantially parallel to the direction of insertion said siphon tube through said annular discharge opening into said furnace, said travelling frame, in turn, being supported for travelling along a horizontally oriented fixed track with direction substantially perpendicular to said direction of insertion.

14. An apparatus according to claim 12 which also includes a non-rotating furnace end closure assembly for said axial discharge opening, equipped with openings through which said slag-suction and metal siphon tubes are inserted, said assembly being supported in fixed radial and longitudinal relation to the furnace by a circumferential guide track fixed to the rotary furnace shell.

15. An apparatus according to claim 12 which also includes a non-rotating furnace end closure assembly for said axial discharge opening, equipped with openings through which said slag-suction and metal siphon tubes are inserted, said assembly being supported in fixed radial and longitudinal relation to the furnace by a circumferential guide track fixed to the rotary furnace shell; and a pressurized, annular gas-curtain seal spanning the clearance between the periphery of said enclosure and the furnace discharge end structure, thereby being adapted to substantially prevent interchange between interior furnace gases and the external atmosphere via said clearance as required for free relative rotation.

* * * * *